United States Patent [19]

Kaminski

[11] 4,068,369

[45] Jan. 17, 1978

[54] METHOD OF MAKING PUSHBUTTON KEYBOARD SYSTEM

[75] Inventor: Perry W. Kaminski, Norton, Mass.

[73] Assignee: Texas Instruments Incorporated, Dallas, Tex.

[21] Appl. No.: 716,034

[22] Filed: Aug. 20, 1976

Related U.S. Application Data

[62] Division of Ser. No. 535,468, Jan. 10, 1975, Pat. No. 3,996,427.

[51] Int. Cl.[2] ..... H01H 13/26

[52] U.S. Cl. ..... 29/622; 29/626; 200/5 R; 200/159 B

[58] Field of Search ..... 29/622, 628, 626; 200/5 R, 5 A, 159 B, 302, 340, 275

[56] References Cited

U.S. PATENT DOCUMENTS

| | | | |
|---|---|---|---|
| 2,262,777 | 11/1941 | Roper | 200/159 B |
| 3,684,842 | 8/1972 | Baulanger | 200/5 R |
| 3,749,859 | 7/1973 | Webb et al. | 200/5 R |
| 3,796,843 | 3/1974 | Durkee et al. | 200/5 A |
| 3,806,673 | 4/1974 | Boulanger | 200/5 A |
| 3,860,771 | 1/1975 | Lynn et al. | 200/5 A |
| 3,886,335 | 5/1975 | Hendricks | 200/1 R |

*Primary Examiner*—Victor A. DiPalma
*Attorney, Agent, or Firm*—John A. Haug; James P. McAndrews

[57] ABSTRACT

A keyboard system for an electronic pocket calculator or the like comprises a substrate board having a generally flat surface with a network of circuit paths thereon. The board is provided with switch contacts at a plurality of switching stations and terminals at a margin of the board for electrical interconnection to other electronic components (e.g., to the solid state logic components or the like on the motherboard of the calculator). Conductor paths and the network of circuit paths interconnect the contacts and the terminals. A dielectric layer is disposed on the substrate leaving the portions of the network of circuit paths exposed. A plurality of spaced electrically conductive inner contact portions are disposed on the substrate in electrical communication with certain ones of the exposed circuit paths and a plurality of outer contact portions are disposed on the top of the dielectric layer, an outer contact portion adjacent each inner contact portion, the top surface of the outer contact portion spaced from the substrate a greater distance than the top surface of the inner contact position is spaced from the substrate. A switch actuating electrically conductive disc is placed over each outer contact portion and is resiliently deformable between an initial position in which its outer margin is in contact with the outer contact portion and in which it is clear of the inner contact portion and an actuated position in which the outer margin of the disc remains in contact with the outer contact portion and in which one point of the disc is in contact with the inner contact portion thereby to complete a circuit between the inner and outer contact portions. A sheet of flexible insulative material is adhesively bonded to the keyboard and to the outer faces of the discs for securing the discs in position relative to their respective contact portions for permitting the discs to be deformed to their actuated positions and for sealing the discs to the board.

13 Claims, 6 Drawing Figures

METHOD OF MAKING PUSHBUTTON KEYBOARD SYSTEM

This is a division, of application Ser. No. 535,468, filed Jan. 10, 1975 now U.S. Pat. No. 3,996,427.

BACKGROUND OF THE INVENTION

This invention relates to a manual pushbutton keyboard system for an electronic pocket calculator, for a pushbutton telephone, or for other electrical or electronic appliances, and it is particularly concerned with such a keyboard which utilizes dished or domed discs as switch actuating elements of single-pole, single-throw (SPST) momentary switches for the keyboard.

More generally, calculator keyboards conventionally include a plurality of SPST momentary switches and a network of conductor paths on a printed circuit board leading to terminals at one margin of the board for connection of the keyboard switches to other electronic components, such as to various solid state, integrated circuit, and semi-conductor logic components within a calculator. Prior art keyboards, such as shown in the coassigned U.S. Pat. Nos. 3,684,842, 3,806,673 and 3,808,384, utilized domed discs as switch actuating elements. Use of such domed discs is desirable for various reasons including the tactile feedback the disc gives the operator when the disc suddenly moves from an unactuated position to an actuated position however in order to optimize this tactile feedback the outer peripheral margin of the disc must be higher than the inner contact so that the disc can move through the plane in which its margin lies. One way of providing different levels for the support of the disc and the inner contact is to mold the keyboard substrate having recesses formed therein so that the central surface portion of the board located beneath a respective disc will be at a lower level than the margin of the disc however providing such different levels makes it difficult and relatively costly to apply the required electrically conductive contacts and paths required. For instance, one known approach involves chemically etching metal from a laminated insulative board in a preselected pattern. This so-called subtractive method of producing a printed circuit board is relatively slow and expensive and it poses certain ecological problems in the disposal of chemical wastes. Additive electroless plating processes can be employed but recesses pose a problem in plating the vertical surfaces of the recesses so that special provisions must be made to avoid the problem.

SUMMARY OF THE INVENTION

Among the many objects of this invention may be noted the provision of a keyboard system which requires a minimum number of parts; the provision of such a keyboard system in which the conductive path may be readily and inexpensively formed on different levels in order to enhance the tactile feedback of the actuating discs employed therewith, the provision of such a keyboard in which the switch actuating elements are retained in position in a simple and efficient manner without the use of a retainer board and in which the substrate board is of minimum thickness; and the provision of such a keyboard which is inexpensive to manufacture and easy to assembly. Other objects and features of this invention will be in part apparent and in part pointed out hereinafter.

Briefly, a keyboard system of this invention has a substrate board having a generally flat surface with a network of circuit paths thereon. The board may be metallic with a dielectric layer thereon on which the circuit paths are disposed or it may be a conventional insulative substrate. In any event, switch contacts are provided at a plurality of switching stations on the substrate and are interconnected by conductive paths. The network of circuit paths also provide interconnection with terminals. A dielectric layer is disposed on the substrate leaving portions of the network exposed. A plurality of spaced electrically conductive inner contact portions are disposed on the substrate in electrical communication with certain ones of the exposed circuit paths. A plurality of outer contact portions are disposed on the top of the dielectric layer, an outer contact portion adjacent each inner contact portion, the top surface of the outer contact portions spaced from the substrate a greater distance than the top surface of the inner contact portions is spaced from the substrate. A switch actuating electrically conductive disc is placed over each outer contact portion and is resiliently deformable between an initial position in which its outer margin is in contact with the outer contact portion and in which it is clear of the inner contact portion and an actuated position in which the outer margin of the disc remains in contact with the outer contact portion and in which one point of the disc is in contact with the inner contact portion thereby to complete a circuit between the inner and outer contact portions. A sheet of flexible insultative material is adhesively bonded to the keyboard and to the outer faces of the discs for securing the discs in position relative to their respective contact portions, for permitting the discs to be deformed to their actuated position, and for sealing the discs to the board.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
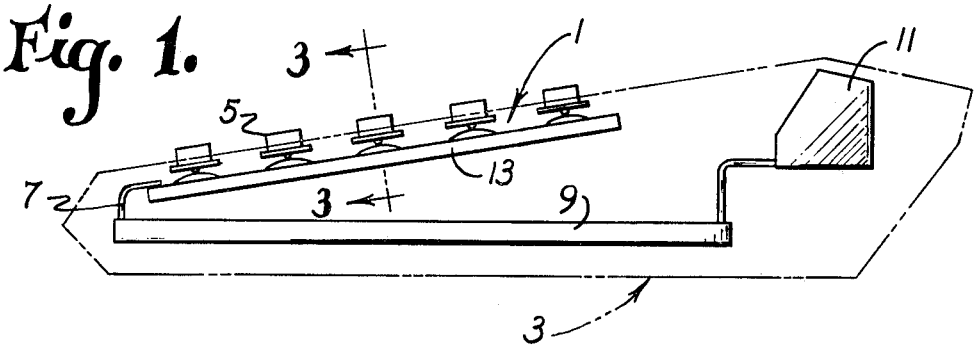
FIG. 1 is a side elevational view of a pocket calculator in which the major components of the calculator including its case, its display module, and its motherboard carrying various electronic logic components (not shown) are illustrated and in which a keyboard system of the invention is installed.

Referring now to the drawings, a keyboard system of this invention, indicated in its entirety at 1, is shown in FIG. 1 installed in an electronic pocket calculator 3. The keyboard system is actuated by manually operable pushbuttons 5 and is electrically connected by umbilical wires 7 to other electrical or electronic components, such as solid state logic components (not shown) on a motherboard 9 within the calculator. The calculator displays its output on a light-emitting diode (LED) display module 11. The power supply for the calculator is not shown.

More particularly, keyboard system 1 comprises a substrate board 13 which has a relatively flat surface. Substrate 13 may be a metallic substrate with a dielectric layer thereon such as a steel sheet 15 having porcelain enamel layer 17 thereon. Alternatively an anodized aluminum sheet may be used or a conventional electrically insulative laminated circuit board. On top of dielectric layer 17 (or the insulative laminated circuit board, if used) a network of circuit paths 19 may be formed in any conventional manner interconnecting terminals 21 with various switch stations 23. A switch actuating element 25 is provided at each station 23. These elements are shown to be concave-convex dome discs of a resilient, electrically conductive material, such as stainless steel, phosphor bronze or the like, having a convex outer face and a concave inner face. As generally indicated at 27 in FIG. 2, so-called conductor means are provided on board 13. Conductor means 27 includes switch contact means 29 at each switch station, terminal means 21 at one margin of board 13 for electrical interconnection to umbilical wires 7, circuit paths 19 on enamel layer 17 and conductive paths 31 interconnecting various switch contact means 29 and the circuit paths 19.

Contact means 29 includes an outer contact portion 35 on the surface of a dielectric layer 37. Dielectric layer 37 is formed with an array of apertures 39 in which is located inner contact portion 41 of contact means 29. The outer contact portion 35 are connected to terminal means 21 via conductor paths 31 and circuit path network 19 through one or more apertures 49 in dielectric layer 37 and the inner contact portion 41 are connected to terminal means 21 via conductor path 33 of circuit path network 19.

Discs 25 are resiliently deformable from an initial position in which the outer margin of the disc is in engagement with its respective outer contact portion surface 35 and in which it is clear of its respective inner contact portion surface 41 and an overcentered actuated position (see FIG. 5) in which a point on its initially concave face (i.e., its center) contacts its inner contact portion surface 41 thereby to complete a circuit between contact surfaces 35 and 41.

A sheet 43 of flexible insulative material such as polyethylene-terephthalate, commercially available under the trade designation MYLAR from the E. I. du Pont de Nemours and Company, is adhesively bonded (as by a coating of pressure-sensitive adhesive applied to one face of the sheet) to one face of board 13 and to the outer or initially convex faces of discs 25. Thus, sheet 43 secures the discs in position on the board relative to their respective contact portions, permits the discs to be deformed to their overcentered actuated positions, and seals the discs to the board so as to prevent dirt or other contaminates from lodging in the recesses between the discs and the contact portion surfaces which may deleteriously affect operation of the keyboard system.

Figure 2:
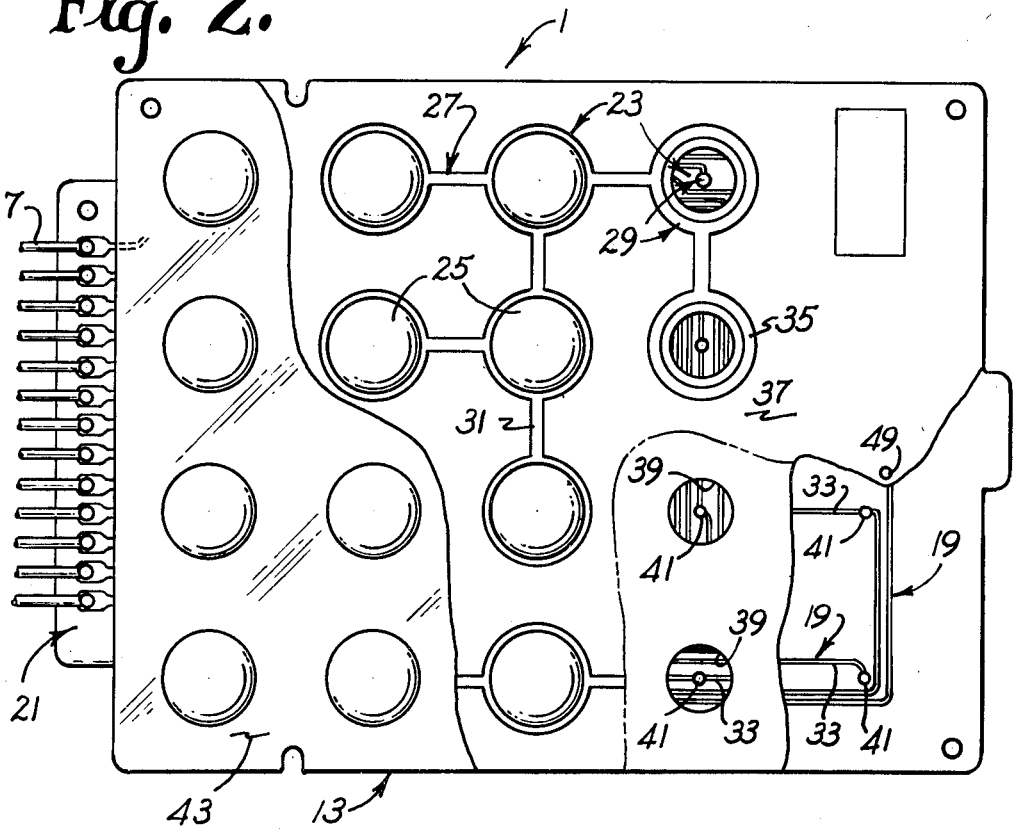
FIG. 2 is an enlarged plan view of the keyboard system with some parts broken away for clarity.
Figure 3:
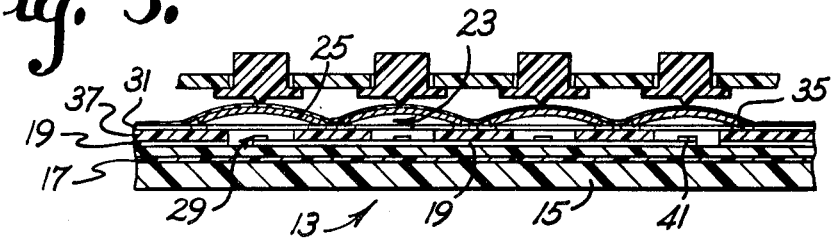
FIG. 3 is an enlarged section taken on line 3—3 of FIG. 1.

As best shown in FIGS. 2 and 3 a substrate 15 having a flat surface and a dielectric layer thereon is provided with a network of circuit paths 19. A relatively thick layer 39 of dielectric material of devitrifying glass, recrystallizing glass, thermosetting resin or other suitable material is placed on top of board 13 again preferably by screen printing so that the top surface of layer 37 is spaced at a selected height above the substrate. Layer 37 is provided with an array of apertures 39 each aligned with a portion of conductive paths 33 of network 19 to thereby expose the top surface thereof. On top of selected portions of circuit paths 19, in particular on conductive paths 33, a plurality of inner contact portions 41 are applied preferably by screen printing. Portions 41 as well as network 19 may comprise a conventional glass-frit based nickel, copper or silver or a molecular bond frittless silver, gold etc. At the same time and composed of the same material as that used for the inner contact portion 41, electrically conductive outer contact portion 35, preferably generally annular in configuration, and, conductor paths 31 joining contact portion 35 are applied. The conductive material also extends through at least one aperture 49 into contact with network 19.

The difference in the distance from the substrate to contact portion 35 and 41 is relatively small compared to the domed height of discs 25. For example, disc 25 may have a domed height of 0.010 inch (0.25 mm) and the difference in the two distances may be between 0.003 – 0.004 and (0.08 – 0.10 mm). Disc 25 has a diameter intermediate the inner and outer diameter of outer contact annular portion 35 so that the outer margin of the disc is supported on the outer contact portion surface 35 a selected distance above the inner contact portion 41. As described, inner contact portion 41 has a top surface above conductor paths 33 and dielectric layer 17 forming a moat which serves as a reservoir into which dust particles and other solid contaminates may be received so as to prevent these contaminates from lodging on the upper surface of inner contact portion 41 when they could prevent electrical contact between discs 25 and the inner contact upon the disc being moved to its over centered position.

As stated above, outer contact portion 35 is shown to be annular in shape while discs 25 are generally circular in plan and of dish-shaped cross section having a double curved outer surface, such as a segment of a spheroid, and having a generally convex upper surface of curvature when they are in their initial or rest position, this convex surface being engageable by tits 53 on push button keys 5. The disc has an over centered actuated position when its center portion is subjected to a preselected deflecting force and it automatically returns to its initial position upon removal of the deflecting force, whereby the element has a mechanical memory to return to its initial position. Of course, these actuating elements may have shapes other than those shown and described herein. Preferably, the disc undergoes a sudden deflection from its initial to its over centered actuated position as it establishes electrical contact with its respective inner contact portion 41. As a result of this sudden deflection, tactile feedback is provided to the operator depressing the key which may be sensed in the fingertips. Furthermore, this sudden overcentering may provide an audible signal thus indicating the pushbutton has been properly depressed to generate the desired electrical signal. It will be noted that due to the difference in height between the inner and outer contact portion the center of the disc is able to move below its outer margin by about 0.003 – 0.004 inch (0.08 – 0.10 mm) providing for the desired tactile feedback effect.

Contact portions 35, 41 and dielectric layer 37 are preferably applied by a conventional thick film screen printing process as used for instance in the field of hybrid microelectronics as a convenient way to apply such layers as well as to obtain the desired height differential between the contact surfaces. A low temperature system is preferred but is not essential. For more details on such typical processes reference may be had to *Thick Film Hybrid Microcircuit Technology* by Donald W. Hamer and James V. Biggers, published in 1972 by Wiley-Interscience of New York, for example, chapter 2, pages 29–55.

In assembling the keyboard system according to this invention, the requisite number of discs 25 (e.g. 18 discs are required for the keyboard shown in FIG. 1), are arranged in a fixture (not shown), either by hand or by automatic vibratory feed equipment with their concave faces down to correspond to the location of the switch stations 23 on board 13. Insulative sheet 43 with a continuous layer of adhesive material on its under surface is then placed on the fixture and the outer convex faces of the discs are adhesively gripped by the sheet. The sheet with the discs adhesively held thereby is then bonded to the face of substrate board 13 which has been previously screen printed to form contact surface portions 35, 41 and conductor paths 31. It should be noted that network 19 may also be screen printed. Thus, all of the discs on the sheet are simultaneously positioned relative to their respective contact portions and secured in place by adhering sheet 43 to the board 13. Of course, if desired, another dielectric layer may be placed on top of layer 37 formed with apertures therein having a diameter approximately the same as the outer diameter of contact portion 35 and aligned therewith and thus provide seats for discs 25.

In the FIGS. 2, 3 embodiment the switch stations are shown to have conductor paths 33 connecting with inner contact portions 41 which are covered by dielectric material while conductor paths 31 connecting outer contact portions 35 are generally coplanar with portion 35.

Figure 4:
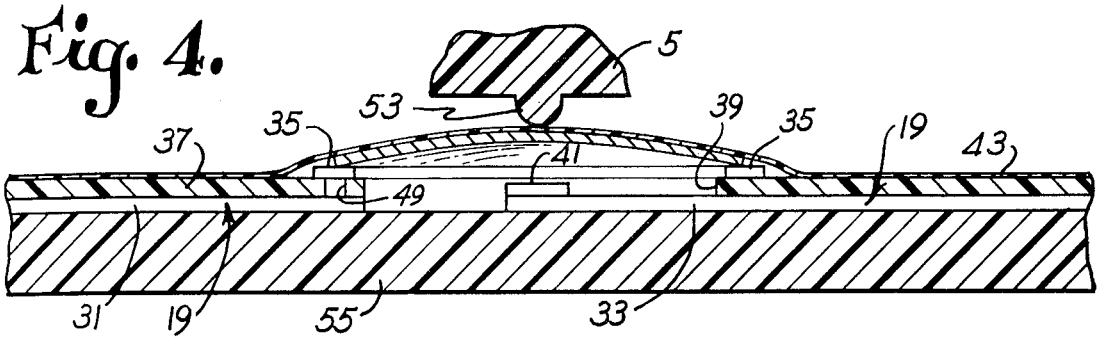
FIG. 4 is a cross section illustrating details of a switching station modified slightly from that shown in FIGS. 2 and 3 and showing the actuating element in its initial convex position.
Figure 5:
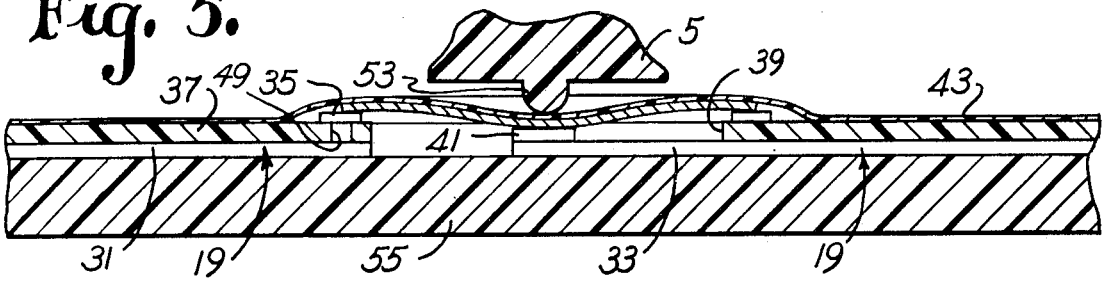
FIG. 5 is a view similar to FIG. 4 illustrating the actuating element in its overcentered actuated position.

FIGS. 4 and 5 show a modification of this arrangement in which both conductive paths 31 and 33 are covered by dielectric layer 37. FIGS. 4 and 5 also depict an arrangement in which the switching station is disposed on an insulative substrate 55 which may be a conventional laminated circuit board having a circuit path network therein.

Figure 6:
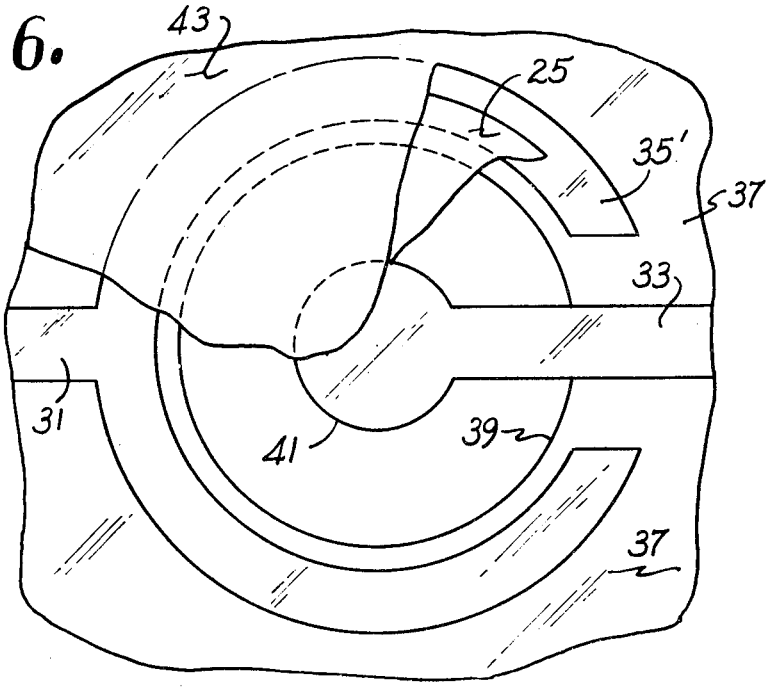
FIG. 6 is an enlarged plan view of a portion of the substrate board illustrating one switch station of a form slightly modified from that shown in FIGS. 4 and 5 with part broken away for clarity.

FIG. 6 shows yet another modification in which both conductive paths 31 and 33 are disposed on top of dielectric layer 27. In this arrangement outer contact portion 35' is in the form of a partial or broken annular ring forming a gap in the outer contact portion to allow conductor path 33 to pass through the gap.

In view of the above, it will be seen that the several objects of the invention are achieved and other advantageous results attained.

As various changes could be made in the above constructions without departing from the scope of the invention, it is intended that all matter contained in the above-description or shown in the accompanying drawings shall be interpreted as illustrative and not in a limiting sense.

I claim:

1. A method of making low profile keyboard switches comprising the steps of providing a substrate having a first relatively flat surface, applying a dielectric layer to selected portions of the substrate leaving an inner contact area exposed, the top surface of the dielectric layer being a first distance from the substrate, simultaneously coating a plurality of spaced electrically conductive inner contact portions on the flat surface within the inner contact area and a plurality of spaced electrically conductive outer contact portions on the top surface of the dielectric layer, an outer contact portion disposed adjacent each inner contact portion, the top surface of the outer contact portion being spaced from the substrate a distance greater than the top surface of the inner contact portion, placing a switch actuating element on each outer contact portion, and disposing retaining means over the substrate to maintain the actuating elements in position relative to their respective contact portion.

2. A method of making a low profile keyboard comprising the steps of providing a substrate having a network of circuit paths on a first face thereof, applying a dielectric layer on said substrate over selected portions of the circuit paths but leaving areas for the inner contact portion exposed, simultaneously coating a plurality of spaced electrically conductive inner contact portions on portions of said exposed circuit paths, and a plurality of spaced electrically conductive outer contact portions on the said dielectric layer and in electrical connection with portions of said circuit paths, an outer contact portion disposed adjacent each inner contact portion, the top surface of the outer contact portion being spaced from the first face of the substrate further than the top surface of the inner contact portions, placing a switch actuating element on each outer contact portion, and disposing retaining means over the substrate to maintain the actuating elements in position relative to their respective contact portions.

3. A method of making a low profile keyboard comprising the steps of providing a substrate having a relatively flat surface, applying a dielectric layer on selected portions of the relatively flat surface of the substrate but leaving areas exposed including areas for inner contact portions, applying a plurality of spaced electrically conductive inner contact portions on exposed areas of the relatively flat surface of the substrate, the top surface of the inner contact portions having a first distance from the substrate surface, and a plurality of spaced electrically conductive outer contact portions on the dielectric layer, the top surface of the outer contact portion being at a second distance from the substrate surface greater than the said first distance, an outer contact portion disposed adjacent each inner contact portion, placing a switch actuating element on each contact portion, and disposing retaining means over the substrate to maintain the actuating elements in position relative to their respective contact portions.

4. A method according to claim 3 in which the substrate is provided with a network of circuit paths prior to applying dielectric layer so that the dielectric layer covers conductive paths leading to both inner and outer contact portions.

5. A method according to claim 3 in which the step of applying the outer contact portions also includes applying electrically conductive paths for the outer contact portions.

6. A method according to claim 3 in which the step of applying the outer contact portions also includes applying electrically conductive paths for the inner and the outer contact portions.

7. A method according to claim 3 in which each of said actuating elements is a generally circular-in-plan domed disc having a convex outer face and a convex inner face, said concave inner face being spaced from said inner contact portion when the disc is in its initual or first position and being in contact with both said inner and outer contact portions when in its second or actuated position.

8. A method according to claim 7 in which the top surface of the outer contact portion is spaced from the substrate further than the inner contact portion from about 0.002 inch (0.05 mm.) to about 0.004 inch (0.10 mm.) whereby, as said disc member moves to its actuated position its center portion moves over center and abruptly moves below the level of its margins supported on the outer contact portion for engagement with said inner contact portion.

9. A method according to claim 8 wherein the outer diameter of said discs is approximately $\frac{3}{8}$ inch (9.5 mm.), and whereby said inner contact portion is spaced below said outer contact portion approximately 0.003 inch (0.08 mm.).

10. A method according to claim 3 in which each outer contact portion is generally annular shaped.

11. A method according to claim 3 in which the substrate is a porcelain enameled steel.

12. A method according to claim 3 in which the electrically conductive paths and contact portions comprise a glass frit silver.

13. A method according to claim 3 in which the dielectric layer comprises a devitrifying glass frit.

* * * * *